US009624839B2

(12) United States Patent
Khan et al.

(10) Patent No.: US 9,624,839 B2
(45) Date of Patent: Apr. 18, 2017

(54) ELECTRONIC THROTTLE BODY ASSEMBLY

(71) Applicants: Continental Automotive Systems, Inc., Auburn Hills, MI (US); GM Global Technology Operations LLC, Detroit, MI (US)

(72) Inventors: Mohammed Rizwan Khan, Chatham (CA); Donald Taylor, Chatham (CA); John Norman Stockbridge, Waterford Township, MI (US); Stefan Köhler, Frankfurt (DE); Nathan Cowan, Chatham (CA); Dean Sorell, Rochester Hills, MI (US)

(73) Assignee: Continental Automotive Systems, Inc., Auburn Hills, MI (US)

( * ) Notice: Subject to any disclaimer, the term of this patent is extended or adjusted under 35 U.S.C. 154(b) by 62 days.

(21) Appl. No.: 14/716,257

(22) Filed: May 19, 2015

(65) Prior Publication Data

US 2015/0337767 A1 Nov. 26, 2015

Related U.S. Application Data

(60) Provisional application No. 62/001,387, filed on May 21, 2014.

(51) Int. Cl.
*B01F 3/04* (2006.01)
*F02D 9/10* (2006.01)
(Continued)

(52) U.S. Cl.
CPC ..... *F02D 9/1035* (2013.01); *B01F 3/04* (2013.01); *F02D 9/10* (2013.01); *F02D 9/105* (2013.01);
(Continued)

(58) Field of Classification Search
CPC ..... B01F 3/04; F02M 19/0207; F02D 9/08; F02D 9/10; F02D 9/1035; F02D 9/1065
(Continued)

(56) References Cited

U.S. PATENT DOCUMENTS 6,095,488 A 8/2000 Semeyn, Jr. et al.
6,543,417 B2 * 4/2003 Tanaka ..... F02D 11/10 123/361
(Continued)

FOREIGN PATENT DOCUMENTS

EP 2075441 A1 7/2009
EP 2497921 A1 9/2012
JP 2013185489 A 9/2013

OTHER PUBLICATIONS

Omnicoil: "Square Wire Spring Manufacturing", Aug. 30, 2012, XP055208070.
(Continued)

*Primary Examiner* — Robert A Hopkins

(57) ABSTRACT

A throttle body assembly includes a housing defining a throttle bore with a throttle plate in the bore and mounted on a shaft. An electric motor has a pinion gear. A gear assembly transfers rotational drive from the electric motor to the throttle plate. Biasing structure biases the gear assembly and thus the shaft to cause the throttle plate to close the throttle bore defining a closed position thereof. When the motor is energized, rotation of the gear assembly, against the bias biasing structure, thereby causing rotation of the shaft to move the throttle plate from the closed position to an open position. A position sensor assembly determines a position of the plate.

13 Claims, 6 Drawing Sheets

(51) Int. Cl.
*F02D 11/10* (2006.01)
*F02M 19/02* (2006.01)

(52) U.S. Cl.
CPC ..... *F02D 9/1065* (2013.01); *F02D 11/10* (2013.01); *F02M 19/0207* (2013.01)

(58) Field of Classification Search
USPC ..... 261/38; 123/361, 399
See application file for complete search history.

(56) References Cited

U.S. PATENT DOCUMENTS

| | | | | |
|---|---|---|---|---|
| 6,918,374 | B1 | 7/2005 | Kurita et al. | |
| 8,448,627 | B2 * | 5/2013 | Kondo | F02D 9/1065 123/361 |
| 2008/0236541 | A1 | 10/2008 | Tsukiji et al. | |
| 2013/0160735 | A1 | 6/2013 | Cowan et al. | |
| 2013/0160738 | A1 | 6/2013 | Cowan | |
| 2013/0284147 | A1 | 10/2013 | Nicholas | |
| 2014/0144407 | A1 | 5/2014 | Khan et al. | |

OTHER PUBLICATIONS

"Powertrain Products" Sep. 30, 2013, XP055208106. pp. 1-2, 61-64 and 99.
International Search Report for PCT/US2015/031585 mailed on Aug. 27, 2015.

* cited by examiner

ELECTRONIC THROTTLE BODY ASSEMBLY

CROSS-REFERENCE TO RELATED APPLICATIONS

This application claims the benefit of U.S. Provisional Application No. 62/001,387 filed May 21, 2014. The disclosure of the above application is incorporated herein by reference.

FIELD

The invention relates generally to an electronic throttle body assembly for controlling air flow into the engine of a vehicle.

BACKGROUND

Throttle body assemblies are generally known, and are used for controlling the amount of air flow into the engine during vehicle operation. Due to the advancement of technology implemented in modern vehicles, and the increased number of options and features available, there have also been greater restrictions placed on the packaging configuration of throttle body assemblies, as well as greater limitations on the location and placement of the throttle body assembly. Requirements are also such that throttle body assemblies be adaptable for gasoline and diesel applications.

Furthermore, with the different orientations of an engine possible within an engine compartment, there is also the requirement for throttle body assemblies to have right-hand and left-hand configurations.

Accordingly, there exists a need for a throttle body or valve assembly which accommodates of the above mentioned requirements.

SUMMARY

The present invention is a throttle body assembly which accommodates various packaging configurations, and is adaptable for both gasoline and diesel applications.

In accordance with an embodiment, a throttle body assembly for controlling aspiration to an engine includes a housing defining a throttle bore. A throttle plate is disposed in the bore and is mounted on a shaft. A gear assembly is constructed and arranged to transfer rotational drive from an electric motor to the throttle plate. Biasing structure is constructed and arranged to bias the gear assembly and thus the shaft to cause the throttle plate to close the throttle bore defining a closed position thereof. A throttle position sensor assembly is constructed and arranged to monitor a position of a sensor element and thus the throttle plate. When the motor is energized, rotation of the gear assembly, against the bias thereon, thereby causing rotation of the shaft to move the throttle plate from the closed position to an open position.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1A:
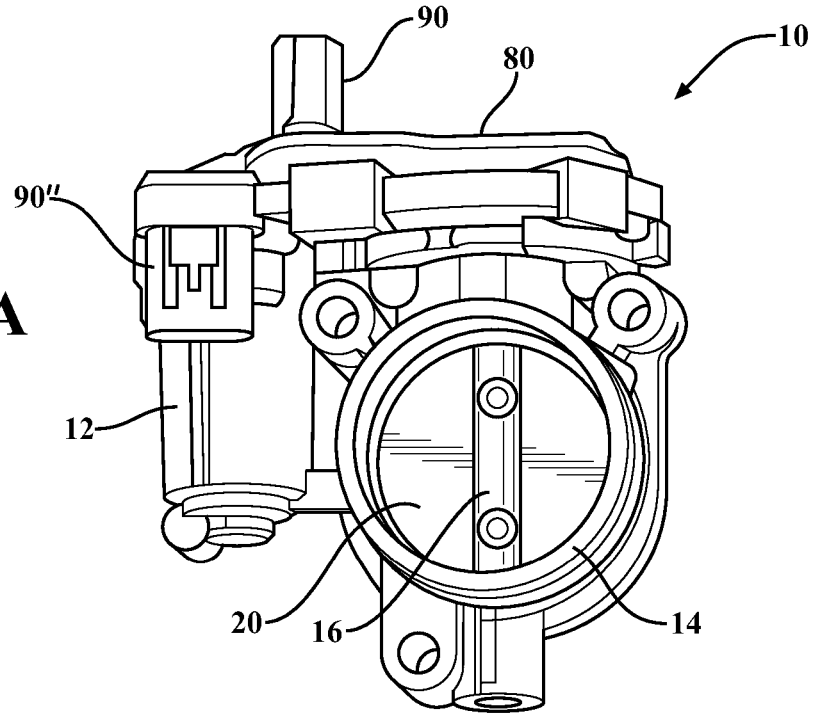
FIG. 1A is a top view of a throttle body assembly, according to an embodiment of the present invention.

A throttle body assembly according to an embodiment is shown, generally indicated at 10, in FIG. 1A for use in controlling aspiration to an engine. The assembly 10 includes a housing 12 with an integral central bore 14, through which air passes during operation of the assembly 10. A rotatable shaft 16 is disposed in the central bore 14. The shaft 16 includes a valve member 20 disposed in a slot formed as part of the shaft 16. In the embodiment, the valve member 20 is in the form of an annular throttle plate.

The shaft 16 is partially disposed in an aperture formed in the housing 12 and disposed transverse with respect to bore 14. At least one needle bearing is disposed in aperture that supports the shaft 16 and allows for the shaft 16 to rotate relative to the housing 12. An actuator, preferably in the form of an electric motor 38, is disposed in a cavity formed as part of the housing 12. A pinion gear 42 is part of a gear assembly, and is attached to the motor 38. The gear assembly is located in a gear box housing 114.

Biasing structure is also located in the gearbox housing. In the embodiment, the biasing structure is a return spring assembly. The biasing structure biases the shaft 16 to cause the throttle plate 20 to close the throttle bore 14.

A cover 80 is connected to the housing 12. More specifically, the gear box housing 114, and partially surrounds the gear assembly. The cover 80 is connected to the housing 12 using a plurality of clips 86. Once the cover 80 is placed on the housing 12, the clips 86 connect the cover 80 to the housing 12. Once the cover 80 is attached to the housing 12 the terminals for the motor 38 can be accessed or viewed through an opening in the cover 80. Once it is determined that the terminals of the motor 38 are in contact with the terminals of a lead frame, a secondary cover 88 is attached to the cover 80 to close the opening. The lead frame is part of the cover 80, and defines motor leads which place the connector 90 in electrical communication with a sensor, the function of which will be explained below.

The lead frame is in electrical communication with a printed circuit board (PCB), and the electric motor 38. The lead frame is also in electrical communication with the connector 90. For reverse motor direction, the polarity of the motor 38 can be reversed.

Figure 1B:
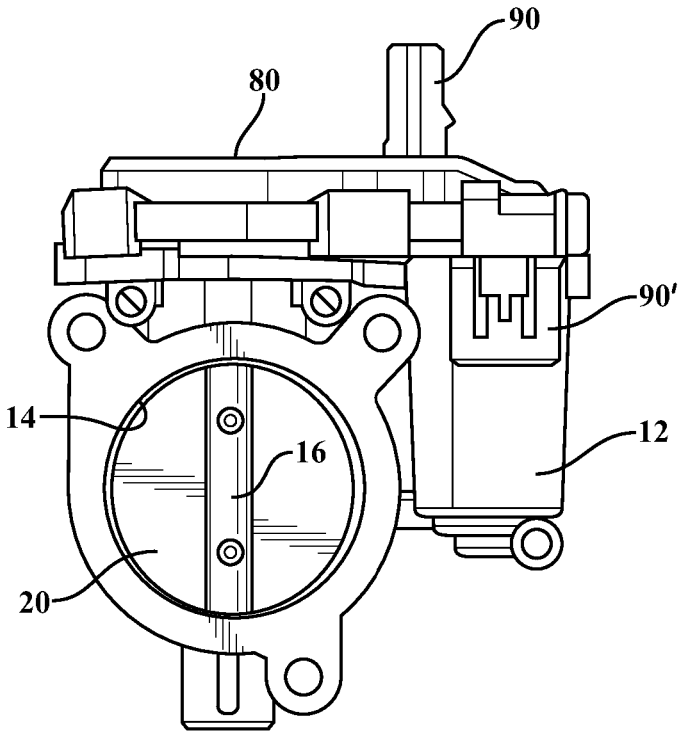
FIG. 1B is a bottom view of a throttle body assembly of FIG. 1A.
Figure 2:
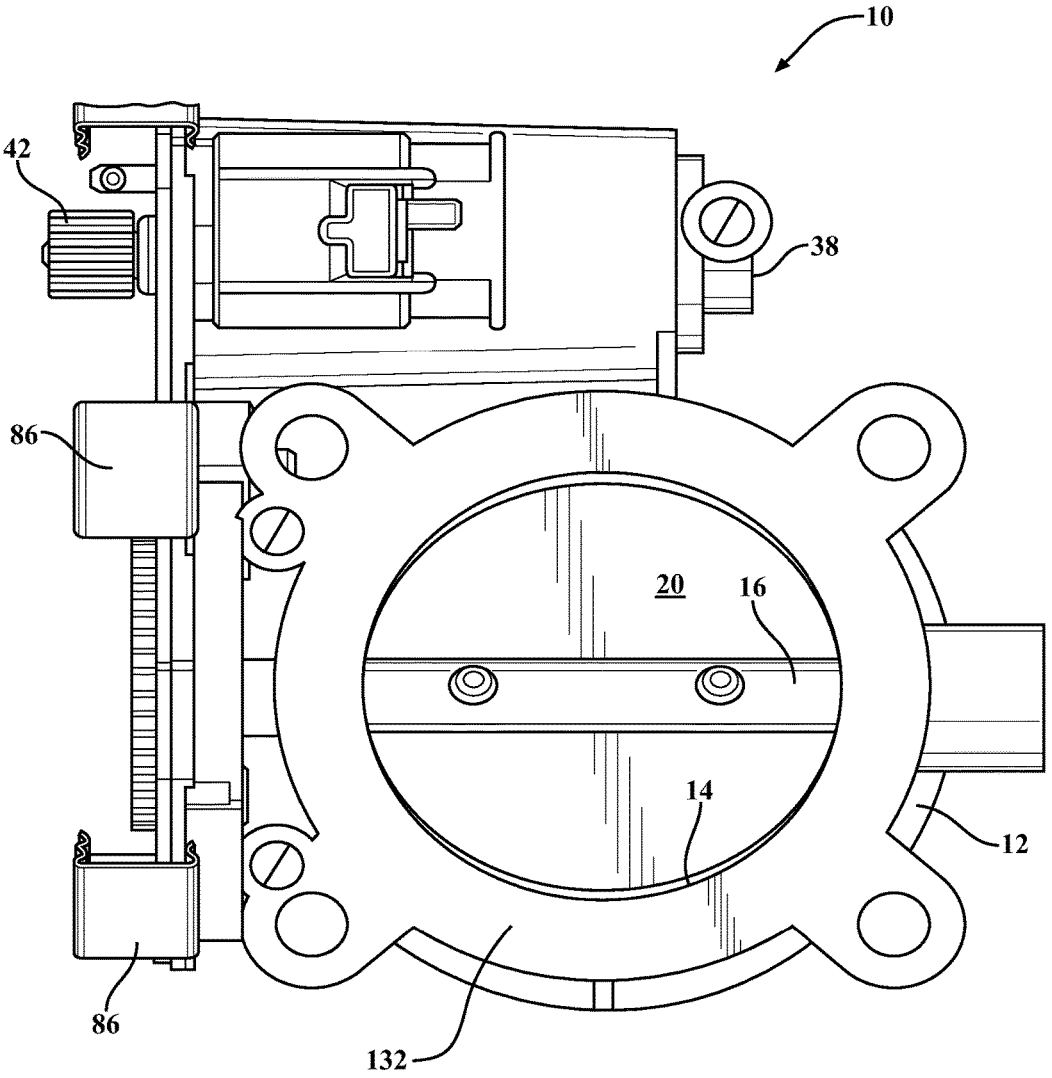
FIG. 2 is a bottom view of a throttle body assembly with the cover removed, according to another embodiment.
Figure 3:
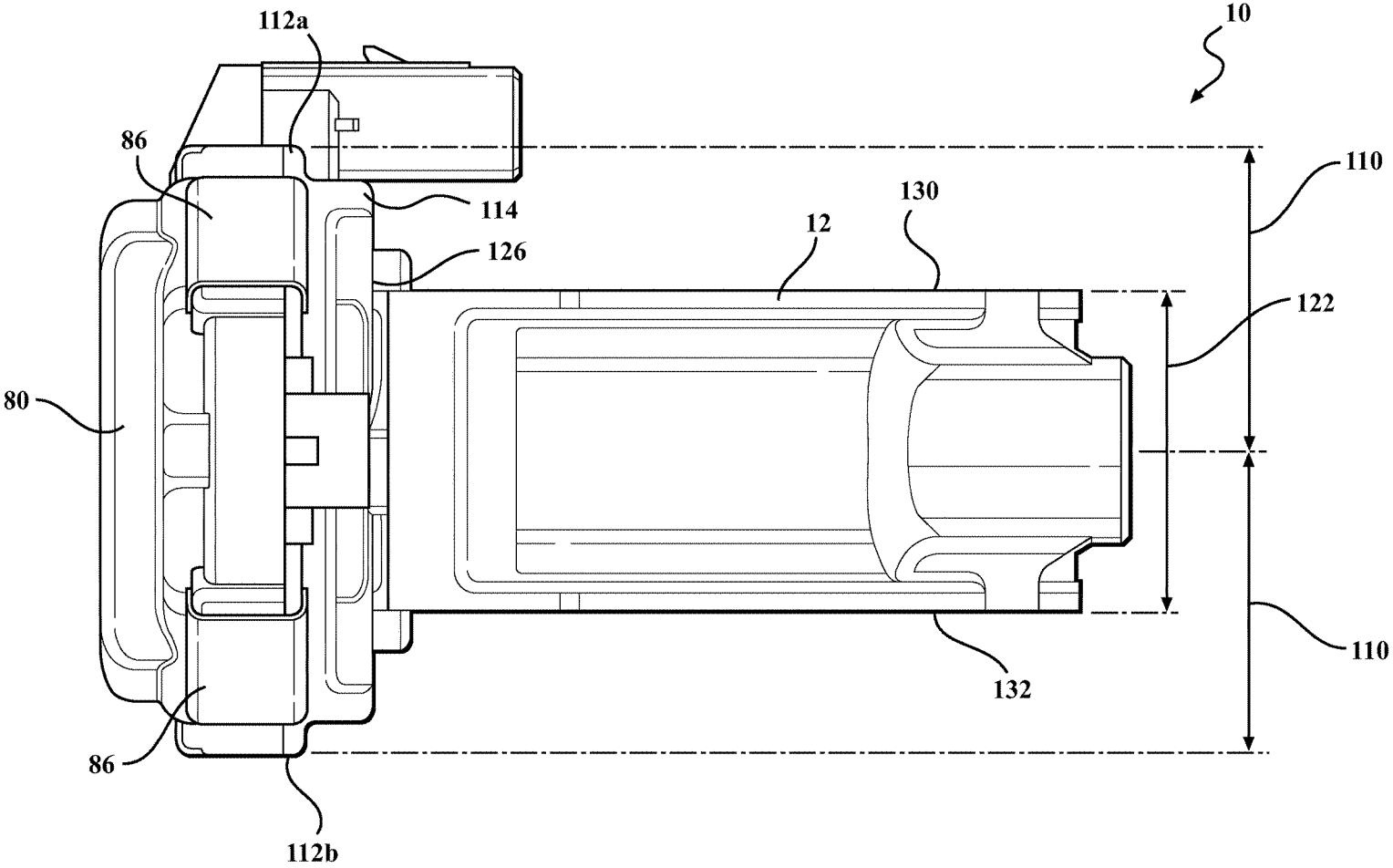
FIG. 3 is a side view of a throttle body assembly, according to a second embodiment of the present invention.

FIGS. 1A and 1B show another embodiment of the cover 80 where a single cover includes all three connectors 90, 90' and 90". Thus, depending on the orientation required, the terminals are provided in the appropriate connector and the leads are configured based on the selected connector location. This ensures a common seal profile, a common cover 80 and common sealing area on the housing 12, which reduces number of components required and thus saves cost. Also, the same cover 80 can be used for different types of sensors.

The throttle body assembly 10 comprises a position sensor assembly that includes a sensor element that is disposed with respect to the position sensor so as to be in an electrically inductive relationship therewith. In this configuration, the position sensor detects movement and position of the sensor element, which is compared to reference data to determine the position of the throttle plate 20. Thus, as the throttle plate 14 is moved between an open position and closed position, the sensor element moves with the gear assembly. Accordingly, movement and position of the sensor element is directly related to movement and position of the throttle plate 20.

In operation, the spring assembly biases the gear assembly, and therefore the shaft 16 and throttle plate 20 towards a closed position, such that the central bore 14 is substantially closed, or blocked completely, depending upon how the assembly 10 is configured. When current is applied to the motor 38, the gear assembly is rotated. To rotate the gear assembly, the bias applied to the gear assembly by the spring assembly is overcome. The amount of rotation of the gear assembly is in proportion to the amount of current applied to the motor 38, which must overcome the force applied to the gear assembly by the spring assembly. As noted above, the sensor element and the position sensor detect the position of the gear assembly and thus the plate 20 during the operation of the throttle body assembly 10.

As the gear assembly is rotated, the shaft 16 is rotated as well, rotating the plate 20, and allowing increased levels of air flow through the central bore 14. The amount of rotation of the gear assembly is detected by the sensor, such that the valve plate 20 may be placed in a desired position.

Figure 4:
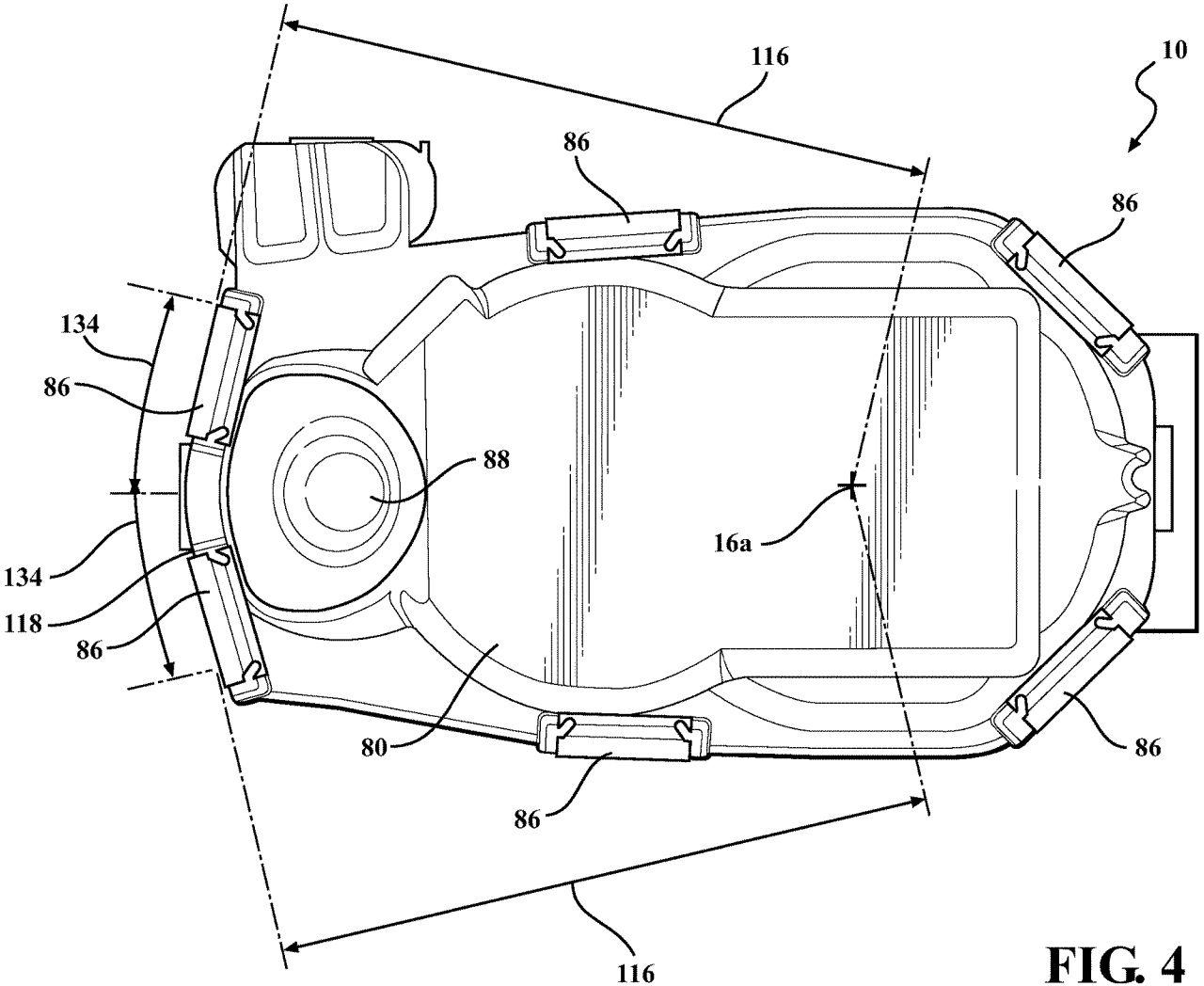
FIG. 4 is a front view of a throttle body assembly, according to a second embodiment of the present invention.

The throttle body assembly 10 also has been configured to have other dimensions that provide advantageous packing. With reference to FIGS. 3-5B, a second embodiment of the assembly is shown, with like numbers referring to like elements. However, in this embodiment, the throttle bore 14 is of a different overall height, which corresponds to the height of several mounting bosses 120. Also, it is shown that the distance 110 from the axis 16*a* of the shaft 16 to the upper edge 112*a* of the gear box housing 114 and the lower edge 112*b* of the gearbox housing 114 is less than 32 millimeters, which still allows for left-hand and right-hand configurations. The measurement of the distance 110 is taken along a line that is substantially perpendicular with the upper surface 130 and lower surface 132 of the bore 14. With reference to FIG. 4, the gearbox housing 114 has a peripheral edge 118, which is the furthest distance away from the axis 16*a* of the shaft 16 compared to any other area of the gearbox 114. The distance 116 from the axis 16*a* of the shaft 16 to the peripheral edge 118 of the gearbox housing 114 is less than 75 millimeters. Each of the measurements for this distance 116 is taken at an angle 134 that is fifteen degrees from horizontal.

Figure 5A:
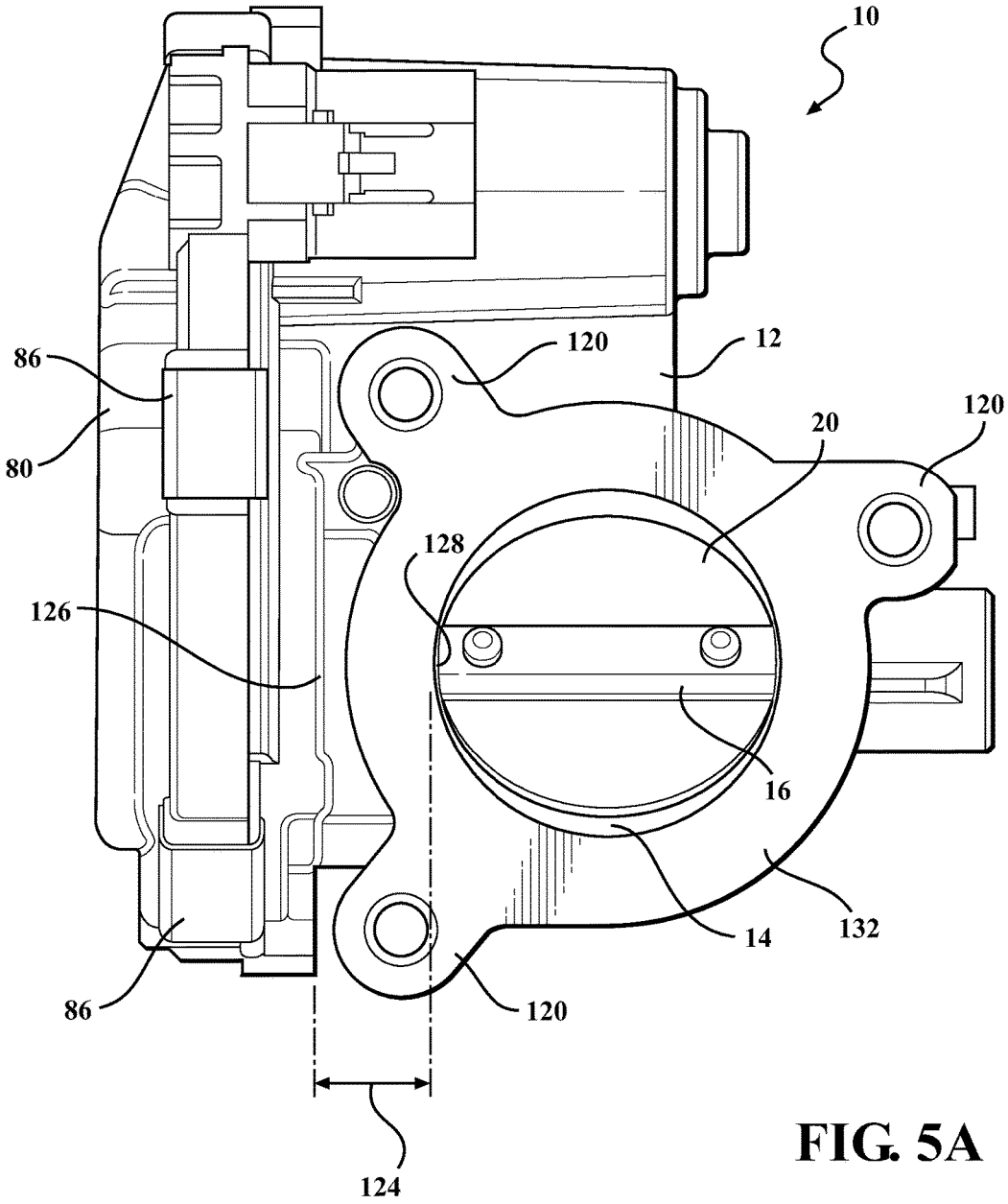
FIG. 5A is a top view of a throttle body assembly, according to a second embodiment of the present invention.
Figure 5B:
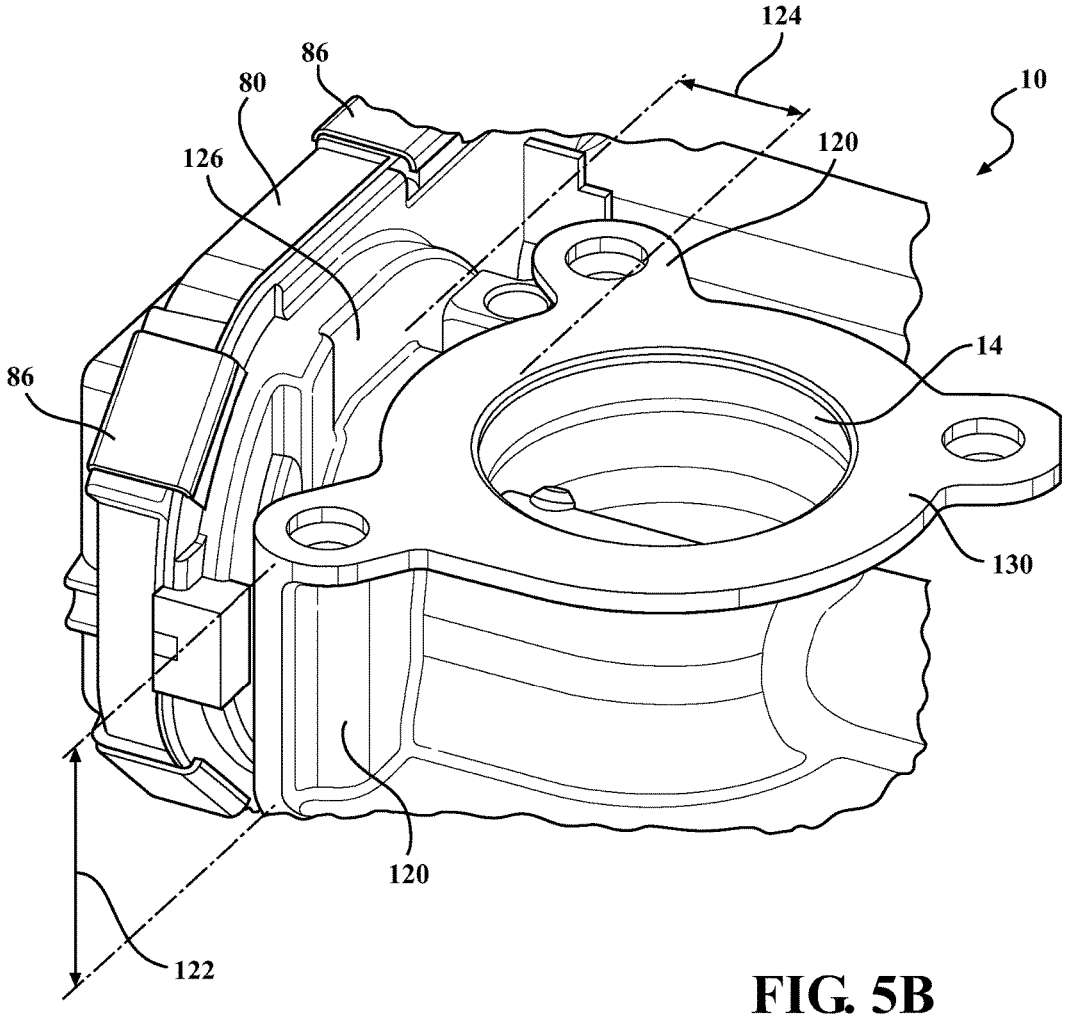
FIG. 5B is a partial perspective view of a throttle body assembly, according to a second embodiment of the present invention.

The housing 12 includes several mounting bosses 120, shown in FIGS. 5A and 5B, where in one embodiment, the mounting bosses 120 are of a height 122 of 20 millimeters, which in the embodiment shown in FIGS. 4-5B corresponds to the height of the central bore 14, with the bore 14 having a diameter of about 40 millimeters. In another embodiment, the height 122 is about 33 millimeters, and the diameter of the bore 14 is about 54 millimeters. The height 122 of each boss 120 is chosen to be suitable where the central bore 14 has a centerline which is straight and has a consistent diameter, or suitable where the central bore 14 is a progressive bore 14 having a centerline which varies (i.e., not straight), while having a consistent diameter. In either embodiment, the surfaces 130,132 are double flat flange surfaces, making the assembly 10 more suitable for mounting.

Another advantage the throttle body assembly 10 provides with regard to packaging is the lateral distance of the bore 14 relative to the gear box housing 114. In FIGS. 5A and 5B, it is shown that the distance 124 from the inside edge 126 of the gear box housing 114 to the innermost edge 128 of the bore 14 is minimized, and in this embodiment, the distance 124 is about 16 millimeters.

With the embodiment, different motor performance is available with the same or different geartrains. The throttle body assembly 10 can be tuned to the application by swapping only the motor 38 and the gear assembly.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An valve assembly comprising:

a housing defining a throttle bore;

a throttle plate disposed in the bore and mounted on a shaft;

an electric motor having a pinion gear;

a gear assembly being constructed and arranged to transfer rotational drive from the electric motor to the throttle plate; and biasing structure constructed and arranged to bias the gear assembly and thus the shaft to cause the throttle plate to close the throttle bore defining a closed position thereof;

the housing further comprising:

at least one mounting boss integrally formed as part of the housing, the at least one mounting boss is used for mounting the throttle assembly to a manifold;

wherein, when the motor is energized, rotation of the gear assembly, against the bias thereon, causes rotation of the shaft to move the throttle plate from the closed position to an open position, and the height of the at least one boss is 33 millimeters or less, and the diameter of the central bore is 54 millimeters or less.

2. The assembly of claim 1, further comprising:

a gear box housing having an upper edge and a lower edge, the gear assembly disposed in the gearbox housing, the gearbox housing being part of the housing;

wherein the distance from the axis of the shaft to the upper edge of the gear box housing, and the distance from the axis of the shaft to the lower edge of the gearbox housing allows for left-hand and right-hand configurations of the assembly.

3. The assembly of claim 2, wherein the distance between the axis of the shaft to the upper edge of the gear box housing is less than 32 millimeters.

4. The assembly of claim 2, wherein the distance between the axis of the shaft to the lower edge of the gear box housing is less than 32 millimeters.

5. The assembly of claim 2, wherein the measurement of the distance from the axis of the shaft to the upper edge is taken along a line that is substantially perpendicular with the upper surface and lower surface of the throttle bore.

6. The assembly of claim 2, the gear box housing further comprising a peripheral edge which is the furthest distance away from the axis of the shaft compared to any other edge of the gearbox.

7. The assembly of claim 6, wherein the distance from the axis of the shaft to the peripheral edge of the gearbox housing is less than 75 millimeters.

8. The assembly of claim 6, wherein the peripheral edge of the gearbox is located at an angle that is fifteen degrees from horizontal.

9. The assembly of claim 1, wherein the height of the at least one boss is 20 millimeters or less, and the diameter of the central bore is 40 millimeters or less.

10. The assembly of claim 1, wherein the height of the at least one boss is suitable for use when the throttle bore is substantially straight, or when the throttle bore is a progressive bore.

11. The assembly of claim 1, wherein the height of the at least one boss is substantially the same as the height of the throttle bore.

12. The assembly of claim 1, wherein the upper surface and the lower surface of the throttle bore are double flat flange surfaces.

13. The assembly of claim 2, wherein the lateral distance from the inside edge of the gear box housing to the innermost edge of the bore is about 16 millimeters.

* * * * *